US008049169B2

(12) United States Patent
Satake et al.

(10) Patent No.: US 8,049,169 B2
(45) Date of Patent: Nov. 1, 2011

(54) ION GUIDE DEVICE, ION REACTOR, AND MASS ANALYZER

(75) Inventors: Hiroyuki Satake, Kokubunji (JP); Takashi Baba, Chapel Hill, NC (US); Izumi Waki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 429 days.

(21) Appl. No.: 12/095,075

(22) PCT Filed: Mar. 8, 2006

(86) PCT No.: PCT/JP2006/304498

§ 371 (c)(1), (2), (4) Date: May 27, 2008

(87) PCT Pub. No.: WO2007/060755

PCT Pub. Date: May 31, 2007

(65) Prior Publication Data

US 2009/0278043 A1 Nov. 12, 2009

(30) Foreign Application Priority Data

Nov. 28, 2005 (JP) ..... 2005-341365

(51) Int. Cl.
*H01J 49/42* (2006.01)

(52) U.S. Cl. ..... 250/292; 250/288

(58) Field of Classification Search ..... 250/281, 250/282, 288, 290, 292
See application file for complete search history.

(56) References Cited

U.S. PATENT DOCUMENTS 5,572,035 A * 11/1996 Franzen ..... 250/396 R
5,818,055 A * 10/1998 Franzen ..... 250/292
6,693,276 B2 * 2/2004 Weiss et al. ..... 250/288
6,800,851 B1 * 10/2004 Zubarev et al. ..... 250/292
6,812,453 B2 * 11/2004 Bateman et al. ..... 250/287
6,884,995 B2 4/2005 Bateman et al.
7,166,835 B2 1/2007 Baba et al.
7,196,326 B2 * 3/2007 Franzen et al. ..... 250/288
7,375,344 B2 * 5/2008 Derrick et al. ..... 250/396 R
2004/0031916 A1 2/2004 Bateman et al.
2004/0155180 A1 8/2004 Zubarev

FOREIGN PATENT DOCUMENTS

JP 2003-45372 2/2003
JP 2004-520685 7/2004
JP 2005-235412 9/2005

OTHER PUBLICATIONS

Gibilisco, ed., "The Illustrated Dictionary of Electronics", 2001, McGraw-Hill, 8th Edition, pp. 22, 577.*
Syka, et al., PNAS, Jun. 2004, vol. 101, No. 26, pp. 9528-9533.
Anal. Chem. 2004, 76, 4263-4266, vol. 76, No. 15, Aug. 2004.
Dehmelt, H., "RadioFrequency Spectroscopy of Stored Ions I:Storage", pp. 53-72, Adv. At. MolPhys 353 (1967).

* cited by examiner

*Primary Examiner* — Jack Berman
(74) *Attorney, Agent, or Firm* — Mattingly & Malur, PC

(57) ABSTRACT

A charged particle reaction cell of the present invention has a serially-arranged plurality of ring electrodes, wherein a modulated radio frequency voltage obtained by modulating the amplitude of a radio frequency voltage is applied, whereby ions are captured at the bottom of the ups and downs of a formed pseudopotential and are transferred with the move of the pseudopotential. In the charged particle reaction cell, the time required for the charged particle reaction can be secured and also the problem of the decrease of the throughput or the mass resolution can be solved, and the speed of the structure analysis of a measurement sample can be accelerated.

17 Claims, 11 Drawing Sheets

ION GUIDE DEVICE, ION REACTOR, AND MASS ANALYZER

INCORPORATION BY REFERENCE

The present application claims priority from Japanese Patent Application No. 2005-341365 filed on Nov. 28, 2005, the content of which is hereby incorporated by reference into this application.

TECHNICAL FIELD

The present invention relates to a method and device for analysis of sequence structures of biological macromolecules with the use of mass spectrometry.

BACKGROUND OF THE INVENTION

In mass spectrometry, sample molecules are ionized and introduced into a vacuum (or ionized in a vacuum), and mass to charge ratios of target molecular ions are measured by measuring movements of the ions in an electromagnetic field. Since the obtained information represents macroscopic quantities of the mass to charge ratios, it is difficult to obtain information on internal structure by a single mass analysis. Accordingly, a method called tandem mass spectrometry is used. That is, sample ions are isolated or selected in the first mass analysis. These ions are referred to as precursor ions. Subsequently, the precursor ions are dissociated by a certain technique. The dissociated ions are referred to as fragment ions. The dissociated ions are further mass-analyzed, thereby obtaining information on the generation patterns of the fragment ions. Since there is a rule for dissociation patterns depending on each dissociation technique, it is possible to infer the sequence structure of the precursor ions. Particularly, in the fields of analysis of biomolecules composed of protein, adiabatic reactions, such as charged particle reaction, using Collision Induced Dissociation (CID), Infra-Red Multi-Photon Dissociation (IRMPD), and Electron Capture Dissociation (ECD), Electron Transfer Dissociation (ETD), Proton Transfer charge Reduction (PTR), and Fast Atomic Bombardment (FAB), are used for the dissociation technique.

CID is currently widely used in the field of protein analysis. A kinetic energy is provided to the precursor ions to allow them to collide with gas. Molecular vibration is excited by the collision and the molecular chain is dissociated at sites susceptible to cleavage. Further, a method that has recently come to be used is IRMPD. The precursor ions are irradiated by an infra-red laser to allow them to absorb multiple photons. The molecular vibrations are excited and a molecular chain is dissociated at a site susceptible to cleavage. The sites susceptible to cleavage by CID or IRMPD are sites designated as a-x and b-y in the backbone consisting of an amino acid sequence. It is known that a complete structural analysis cannot be carried out only by CID or IRMPD, because even when sites correspond to a-x and b-y, those are sometimes hard to be cleaved depending on the kind of the amino acid sequence pattern. Therefore, a pretreatment using an enzyme or the like is necessary, which hampers high-speed analysis. Further, when CID or IRMPD is used for post-translationally modified biomolecules, side chains involved in the post-translational modification tend to be easily cleaved. Due to facile cleavage of the side chains, it is possible to determine, based on lost mass, molecular species involved in the modification and whether or not it is modified. However, important information on modification sites concerning which amino acids are modified is lost.

On the other hand, ECD, ETD, and the like, which are the adiabatic dissociating methods using an electron, as other dissociation means, are less dependent on an amino acid sequence (as an exception, proline residue with a cyclic structure is not cleaved) and cleave only one c-z site on the backbone of the amino acid sequence. Therefore, a complete analysis of the backbone chain sequence of a protein molecule can be performed only by the mass spectrometric approach. In addition, ECD, ETD, and the like are suitable for research and analysis of post-translational modification owing to its property of hardly cleaving side chains. Therefore, the dissociation techniques of ECD and ETD have attracted particular attention in recent years. CID and IRMPD, ECD and ETD, and the like can be utilized mutually complementarily because they provide different sequence information, respectively.

In the mass spectrometers of an ion trap type, a quadrupole type, or the like, a radio frequency voltage is applied to a three-dimensional ion trap or to multipole electrodes, thereby focusing the ions to their trajectories.

Non-Patent Document 3 describes a principle that ions are focused to their trajectories in the radial direction by an application of a radio frequency voltage with the use of an idea of pseudopotential. The pseudopotential is the one obtained by expressing a potential in the radial direction formed by a radio frequency voltage with such a potential that is formed by a DC voltage. The ion trap using the radio frequency voltage features that ions can be focused and captured regardless of a positive ion or a negative ion.

Non-Patent Document 1 describes an ETD technique inside a radio frequency ion trap. In a structure of three-series of quadrupole ion traps (LTQ mass spectrometer) provided with wall electrodes, positive ions are introduced from one of two input/output ports for ions placed on both sides and then are kept captured, subsequently negative ions are introduced from the opposite port, and both the positive and negative ions enter into a potential generated by an application of a DC voltage. Then, a secondary radio frequency voltage is applied to the quadrupole and the wall electrodes to react the positive ions and negative ions to each other, thereby causing an ETD reaction.

An ECD technique inside the three-dimensional and radio frequency linear ion traps is described in Patent Document 1 and Patent Document 2. Here, there is proposed the ECD technique, in which a magnetic field is applied onto ion trajectories of the three-dimensional ion trap and linear ion trap, and this magnetic field restricts the electron trajectories so as to avoid the heating of electrons. In the configuration using a three-dimensional ion trap, there is proposed a method, in which a magnet is placed inside a ring electrode or outside an end cap, and electrons are introduced from the outside of the ion trap. Moreover, in the configuration using a linear ion trap, there is proposed a method, in which a magnetic field is applied onto the central axis of the linear ion trap, and electrons are introduced from within the magnetic field onto the ion trajectories.

An ECD technique inside a radio-frequency linear ion trap is described in Non-Patent Document 2. Here, there is described the ECD method, in which a magnetic field is applied to the ion trajectories of a linear quadrupole electrode ion trap to restrict the electron trajectories, thereby avoiding the heating of electrons.

Patent Document 3 discloses a method, in which ions are transported using a DC voltage in a fragment device comprising a serially arranged plurality of electrodes. Namely, a potential hill and well are formed with a DC voltage, and ions are pushed out at this potential hill and are captured at this potential well, whereby the ions are transported by transferring the potential hill and potential well. Moreover, by changing an applying method of the DC voltage, the speed of the potential hill and well can be adjusted, and consequently the transporting speed of ions can be adjusted. This approach can adjust the transit time of ions.

Patent Document 1: U.S. Pat. No. 6,800,851 B1

Patent Document 2: US Patent Application Publication No. US 2004/0155180 A1

Patent Document 3: U.S. Pat. No. 6,884,995 B2

Non-Patent Document 1: John E. P. Syka et al., PNAS, vol. 101, No. 26, pp. 9528-9533

Non-Patent Document 2: Takashi Baba et al., Analytical Chemistry, 2004, vol. 76, pp. 4263-4266

Non-Patent document 3: H. G. Dehmelt et al., Adv. At. Mol-Phys 353 (1967), pp. 53-72

DISCLOSURE OF THE INVENTION

Problems to be Solved by the Invention

A triple-quadrupole mass spectrometer and a quadrupole-TOF mass spectrometer are widely used in protein analysis because the triple-quadrupole mass spectrometer allows for high throughput analysis and quantification, such as a precursor scan or a neutral loss scan, while the quadrupole-TOF mass spectrometer also allows for high throughput analysis. In these devices, although CID is implemented as an ion dissociation technique, not only CID but other new ion dissociation techniques, such as ECD and ETD, are reasonably expected to be implemented for the purpose of improving the efficiency of protein analysis in the future. However, currently, in implementing ETD or ECD in an ion dissociation chamber using a triple-quadrupole mass spectrometer or a quadrupole-TOF mass spectrometer, there are the following problems.

Both the triple-quadrupole mass spectrometer and quadrupole-TOF mass spectrometer comprise a quadrupole mass filter at the preceding stage of the ion dissociation chamber. The quadrupole mass filter plays a role to allow only ions with a specific mass to charge ratio to pass therethrough and removes the other ions. Moreover, the quadrupole mass filter scans the mass to charge ratio to be passed therethrough. The mass scan can be performed at the scanning speed of no less than 1000 amu/sec (amu: atomic mass unit). For example, at a scanning speed of 1000 amu/sec, ions having a different mass by 1 amu are sequentially ejected at every one millisecond. In this case, in order to respond to ions coming one after another at every one millisecond, the dissociation such as CID is needed to be implemented in a short time of no more than 1 msec in the ion dissociation chamber. In the same way, if ECD, ETD, or the like is performed in the ion dissociation chamber, ions are required to be dissociated in a short time of no more than 1 msec.

However, in order to perform ETD, ECD, or the like by means of the triple-quadrupole mass spectrometer or the quadrupole-TOF mass spectrometer, there are currently two problems. A first problem is that according to the previous reports the reaction time of ECD, ETD or the like takes no less than 10 msec and thus a longer reaction time by about one order of magnitude as compared with CID is required. For example, for the quadrupole mass filter with the scanning speed of 1000 amu/sec, the reaction time needs to be set to no more than 1 msec in order to maintain the mass resolution of 1 amu. However, if the reaction time of ETD, ECD, or the like is set to a short time of no more than 1 msec, the quantity of fragment ions will be reduced and it is thus difficult to obtain a spectrum with reasonably good S/N. It is therefore necessary to secure a reaction time of no less than 10 msec in the current ETD, ECD, or the like. This leads to a reduction in the throughput. A second problem is that an ion can pass through a quadrupole ion guide in about several hundreds of microseconds. Since the energy of a sample ion is around several tens of eV, the sample ion passes through the ion trap of about 10 cm in length in about several hundreds of microseconds. Under such conditions allowing the ion to pass straight therethrough, the reaction time of 10 msec cannot be secured. Conventionally, in order to secure the reaction time of 10 msec by reducing the throughput or mass information, a method for capturing ions with a DC voltage has been employed.

Namely, in the configuration, as described in Non-Patent Document 2, a quadrupole linear ion trap and wall electrodes at the both ends thereof are placed and then a DC voltage is applied to the wall electrodes to form a wall of potential at the both ends of the linear ion trap. Thereby, a focusing effect in the radial direction is provided by a pseudopotential due to a radio frequency voltage and thus the ions are focused onto the central axis of the quadrupole, and at the same time, with a DC voltage potential at the wall electrodes, the ions are focused in the axial direction (direction parallel to the quadrupole electrode) and captured. This is an approach of Non-Patent Document 2, which makes it possible to capture ions for no less than 10 msec and secure the reaction time. However, ETD, ECD, or the like needs to be implemented while the wall of potential is formed with the wall electrodes and the electrons are confined, and thereafter the potential of the wall electrodes needs to be reduced to eject the ions. Therefore, there are processes of the accumulation, reaction, and ejection of ions. For this reason, ions cannot be introduced into the ion trap during the reaction or ejection of ions. For this reason, the conventional method must sacrifice either the mass resolution or the throughput, as in the following two examples.

The first one is a method, in which a preliminary ion trap used for ion accumulation is placed at the subsequent stage of the quadrupole mass filter and before the ion dissociation chamber, whereby the ions ejected from the quadrupole mass filter are accumulated for 10 msec by means of the preliminary ion trap and thereafter the ions are allowed to enter into the ion dissociation chamber. In this way, the ions can be introduced into the ion dissociation chamber without loss of the ions. However, in the case of the mass filter with 1 amu/msec, since the ions are accumulated for 10 msec, the ions of the mass by the amount of 10 amu are mixed with each other inside the preliminary ion trap, which leads to a degradation of the mass resolution, causing a problem that the mass information on the ions is lost.

The second one is the fact that the scanning speed of the quadrupole mass filter is reduced to 100 amu/sec. However, in scanning the same mass range, the sample analyzing time takes 10 times longer, causing a problem of a degradation of the throughput.

On the other hand, when a method of Patent Document 3 is employed, difficulty is expected in implementing ETD reaction. For example, it is considered to inject negative ions in order to cause the ETD reaction while positive ions are captured in a potential well and being transported. However, in this case, negative ions cannot enter into a potential in which the positive ions are being captured, the potential consisting of a DC voltage. This is because only either of the positive ions and negative ions can be captured by the potential generated by the DC voltage (i.e., both cannot exist at the same place at the same time) since the positive ions and the negative ions have different electric charge signs to each other. As an alternative method, a high energy may be applied to negative ions so that the negative ions are caused to pass through the potential portion, in which positive ions are present, thereby causing the reaction. However, it is expected that with negative ions having such high energy the reaction efficiency of ETD is low and the reaction will hardly occur.

The present invention solves these conventional problems of the charged particle reaction, and discloses a fast charged particle reaction device, a mass analyzer (i.e., mass spectrometer) including the same, and a method of operating the same.

SUMMARY OF THE INVENTION

An ion guide, an ion reactor, and a mass spectrometer of the present invention comprise: a plurality of electrodes each having a circular hole opened therein, the plurality of electrodes being serially arranged in the axial direction; and two or more power supplies that periodically change a radio frequency voltage amplitude of a voltage applied to the electrodes, wherein phases of the periodically changed radio frequency voltages differ from each other, wherein ions are captured and transferred by a radio frequency electric field formed on a central axis of the plurality of electrodes each having a circular hole opened therein, the plurality of electrodes being serially arranged in the axial direction.

In such configuration, a radio frequency voltage obtained by modulating the radio frequency voltage amplitude is applied, and with this modulation of the radio frequency electric field the transfer speed of an ion is adjusted. The amplitude of the radio frequency voltage is controlled so as to periodically change, and the resulting radio frequency voltage is applied so that the phases at the adjacent electrodes differ from each other by a certain value. Generating a pseudopotential in the radial direction by the radio frequency voltage so as to focus ions is the same as the conventional ion guide or ion trap. However, by modulating the radio frequency voltage amplitude, the ups and downs of the pseudopotential are also generated in the axial direction. Furthermore, a field where the bottom of the ups and downs of the pseudopotential moves at a certain speed is formed, whereby ions are captured by an ion packet of the bottom of the ups and downs of this pseudopotential and the ions are transported along with the movement of the ion packet. The ion packet caused by this pseudopotential features the capability of capturing the positive ions and negative ions at the same time. Moreover, the frequency for modulating the amplitude determines the transfer speed of the ion packet, so that the transit time of the ions inside the charged particle reaction cell can be adjusted.

Moreover, in the device of the present invention, the particle reaction is caused by providing a particle source that generates a medium particle, such as an ion or an electron, capable of changing the electric charge of a sample ion.

As in Patent Document 3, also in the present invention, ions are focused and captured by means of a radio frequency voltage. However, the methods for adjusting the transfer speed of ions differ from each other. In the method of Patent Document 3, with the use of a DC voltage for ions, the DC voltage is sequentially applied to serially arranged electrodes to push out the ions. In this instance, if the electric charge sign of the ion differs, the sign of the DC voltage to be applied becomes opposite and therefore the DC voltage corresponding to each of the positive ions and the negative ions needs to be applied. For this reason, the positive ions and negative ions cannot be transferred as the same ion packet at the same time.

According to the present invention, since the incoming and outgoing of ions are not controlled with the wall electrodes or the like as in the ordinary ion trap, ions can be incident to the charged particle reaction cell at intervals from several milliseconds to several hundreds of microseconds and also the residence time of ions can be extended by about 10 msec or more. Furthermore, by putting the positive ions and negative ions into the same ion packet, 10 msec or more required for the reaction time of the charged particles in ETD can be secured. Moreover, since this is a method in which the incident positive and negative ions pass through the interior of the ion trap and are sequentially ejected with their incident order being kept, it is possible to efficiently cause the reaction during the transportation.

In this way, in a charged particle reaction device using a radio frequency ion trap, the speed of the charged particle reaction can be accelerated. The lowered throughput and mass resolution, which are the problems in implementing the charged particle reaction, can be solved, and the speed of the structure analysis of a measurement sample can be accelerated.

Other objects, features, and advantages of the present invention will be apparent from the following description of the embodiments of the present invention, with reference to the accompanying drawings.

EXPLANATION OF REFERENCE NUMERALS

1 . . . a plurality of electrodes each having a circular hole opened therein, 2 to 7 . . . electrode having a circular hole opened therein, 8 . . . positive ion source, 9 . . . negative ion source, 10 to 13 . . . positive and negative ions, 14 . . . permanent magnet, 15 . . . filament, 16 to 17 . . . wall electrode, 24, 26, 28, and 29 . . . electrode having a hole opened therein, 25, 27, and 30 . . . quadrupole electrode, 31 . . . optical lens system, 32 . . . acceleration part, 33 . . . reflectron, 34 . . . detector, 35 . . . power supply.

BEST MODES FOR CARRYING OUT THE INVENTION

Embodiment 1

Figure 1:
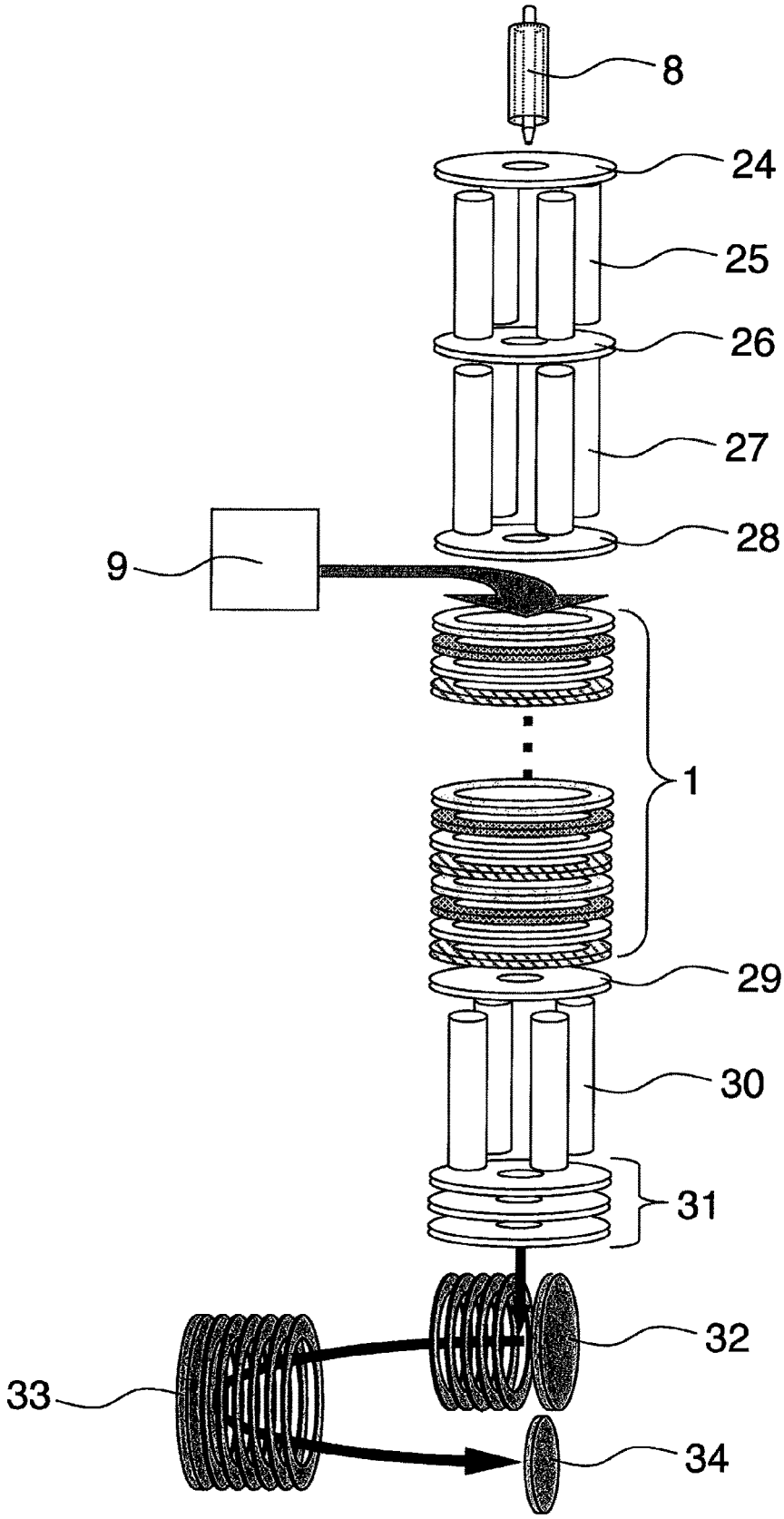
FIG. 1 is a schematic diagram for explaining an embodiment of a mass spectrometer comprising an electron transfer dissociation (ETD) cell comprising a plurality of electrodes each having a hole opened therein; a linear ion trap; and a time-of-flight mass spectrometer.

FIG. 1 is a schematic diagram for explaining an embodiment of a mass spectrometer provided with a unit for an electron transfer dissociation (ETD) reaction, which is a charged particle reaction of positive ions and negative ions in an ion trap. First, the overall flow of the analysis is described, followed by the detail description of the present disclosure.

For a sample of analyte, a sample separated by liquid chromatograph or the like is ionized in a positive ion source 8. The ionized sample is incident upon a quadrupole ion guide part 24 and 25 inside a vacuum device, and passes therethrough and is introduced into a linear ion trap part 26 to 28. He gas, Ar gas, or the like is introduced into the ion trap part, where the sample ion is cooled by collision with the gas. In the linear ion trap part, the accumulation, separation, and ejection of ions are performed and the ejected ions are incident to an electron transfer dissociation cell. The electron transfer dissociation cell for implementing electron transfer dissociation comprises a plurality of electrodes 1 each having a circular hole opened therein. In order to perform the electron transfer dissociation reaction, a negative ion source 9 for generating negative ions is provided, and as shown in the diagram the negative ions are introduced onto the central axis of the plurality of electrodes 1 each having a circular hole opened therein. Immediately after positive ions are incident to the electron transfer dissociation cell, negative ions are introduced to cause the electron transfer dissociation reaction. The ions ejected from the electron transfer dissociation cell are incident to a collision attenuator (collisional-damping chamber) 29 to 30, in which He gas, Ar gas, or the like is introduced, and these ions are focused onto trajectories, whereby the mass to charge ratio is measured in a time-of-flight mass spectrometer part 32 to 34.

Figure 2A:
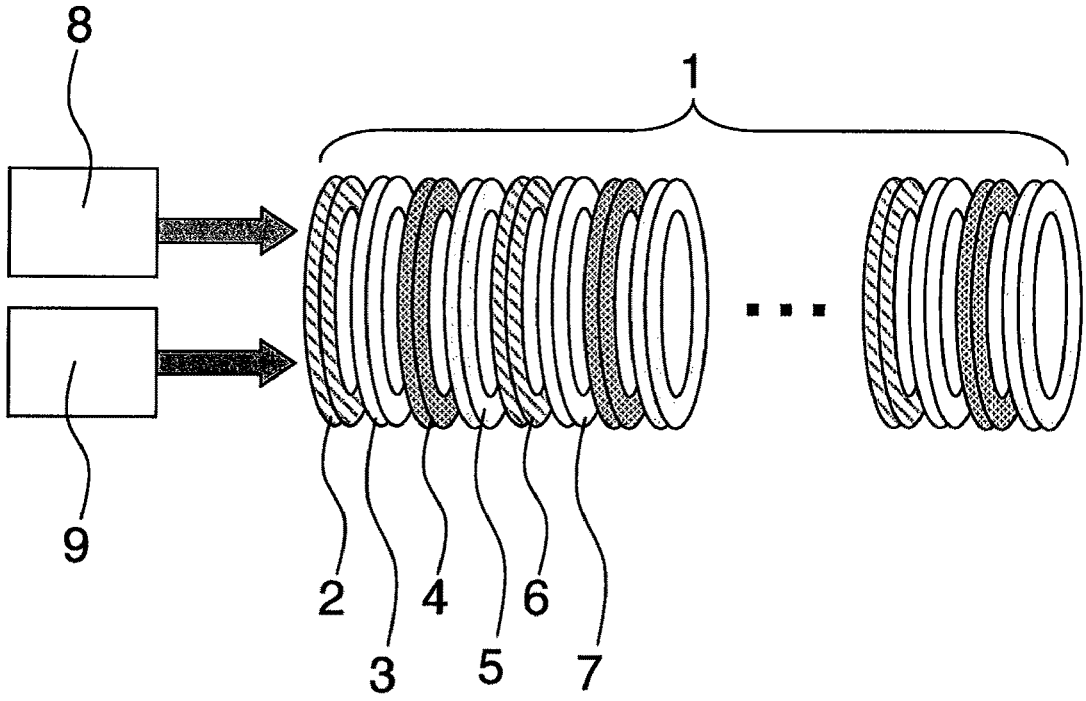
FIG. 2A is a schematic diagram for explaining the embodiment of the electron transfer dissociation (ETD) cell comprising a plurality of electrodes each having a hole opened therein.
Figure 2B:
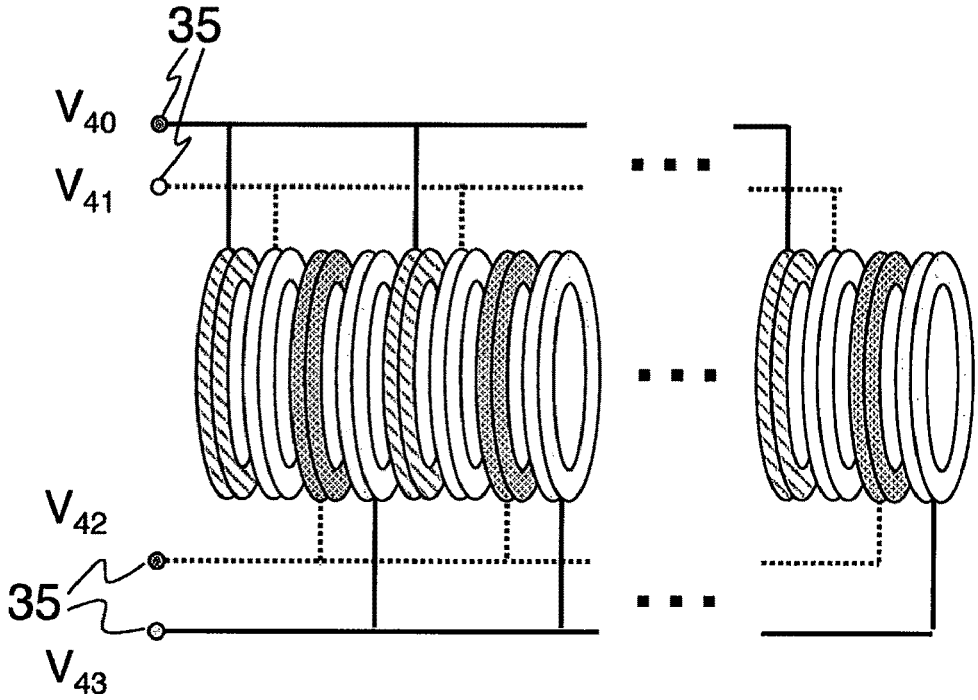
FIG. 2B is a schematic diagram for explaining the embodiment of the electron transfer dissociation (ETD) cell comprising a plurality of electrodes each having a hole opened therein.
Figure 3A:
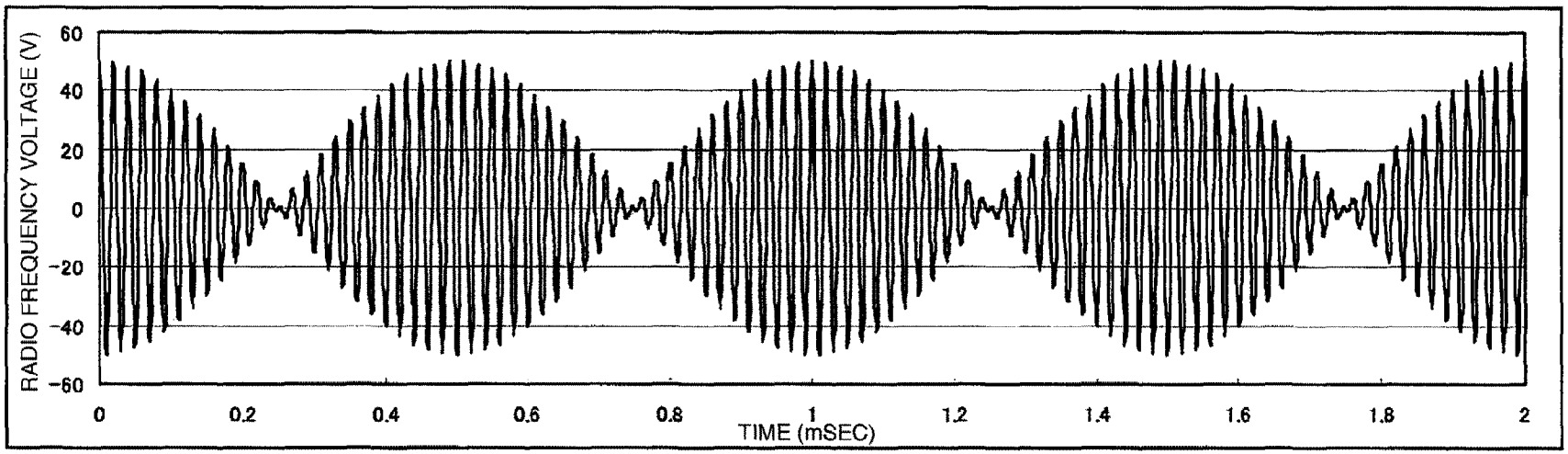
FIG. 3A is a schematic diagram for explaining an example of a voltage ($V_{40}$, n=0) applied to the plurality of electrodes each having a hole opened therein.
Figure 3B:
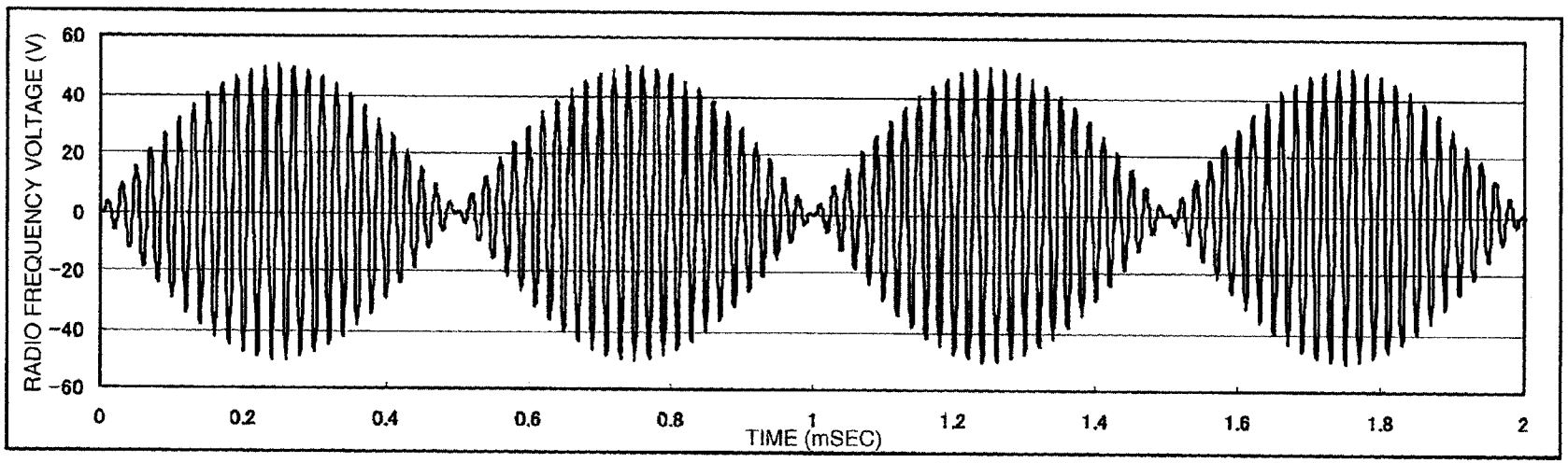
FIG. 3B is a schematic diagram for explaining an example of a voltage ($V_{41}$, n=1) applied to the plurality of electrodes each having a hole opened therein.
Figure 3C:
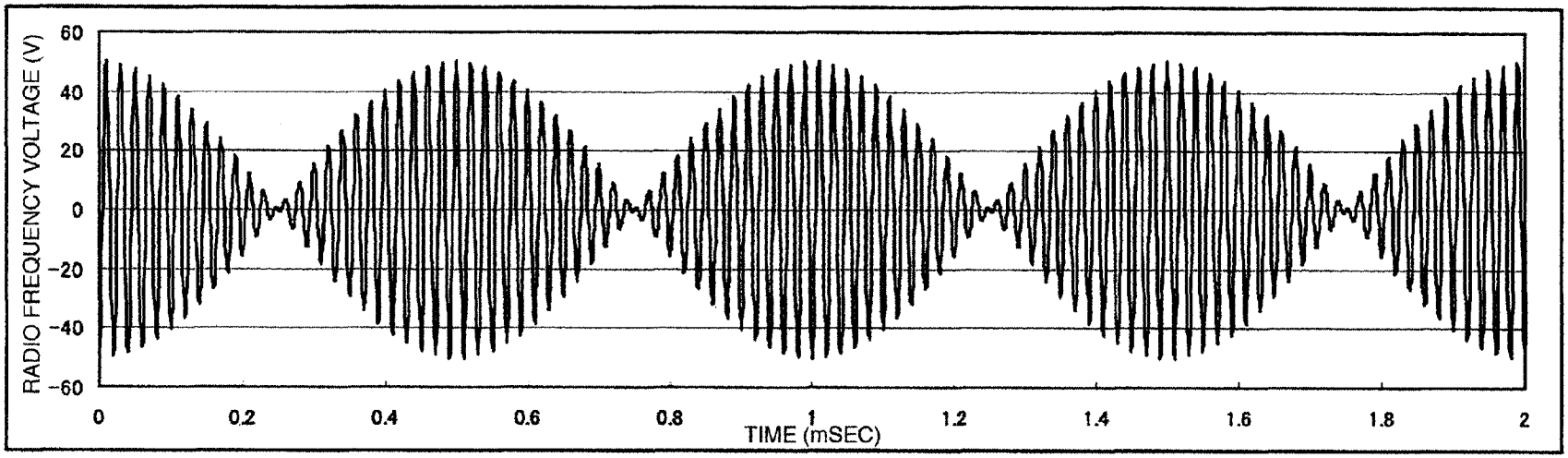
FIG. 3C is a schematic diagram for explaining an example of a voltage ($V_{42}$, n=2) applied to the plurality of electrodes each having a hole opened therein.
Figure 3D:
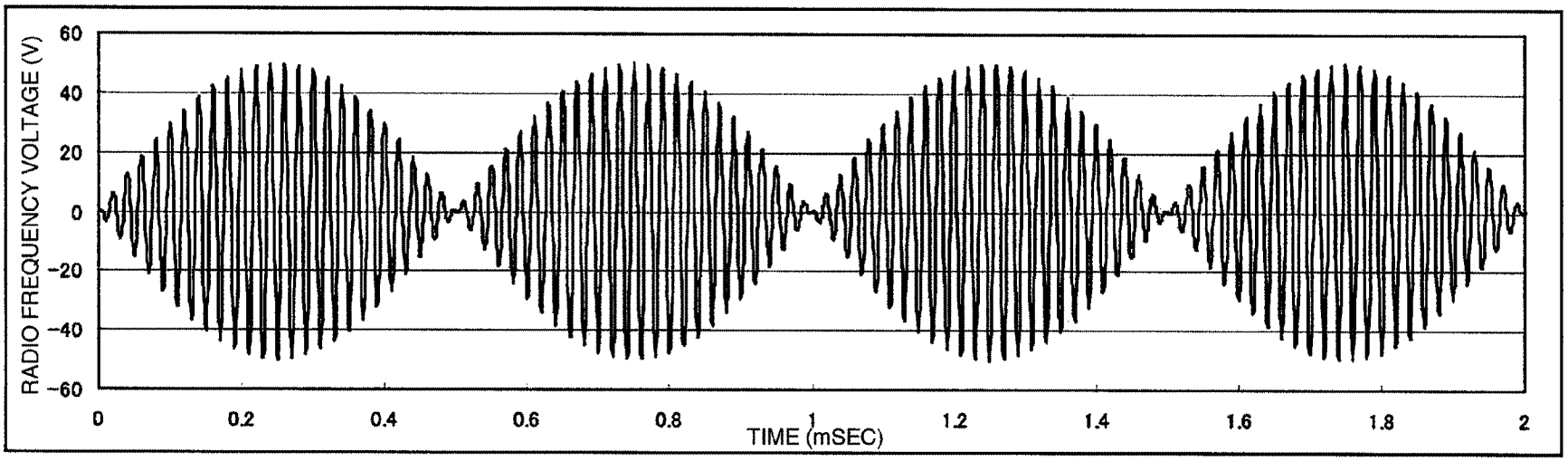
FIG. 3D is a schematic diagram for explaining an example of a voltage ($V_{43}$, n=3) applied to the plurality of electrodes each having a hole opened therein.

The present disclosure is with regard to a method for implementing an electron transfer dissociation reaction in the electron transfer dissociation reaction cell comprising the plurality of electrodes 1 each having a circular hole opened therein of FIG. 1. FIGS. 2A and 2B are schematic diagrams illustrating the details of the electron transfer dissociation reaction cell. In the structure comprising the plurality of electrodes 1 each having a circular hole opened therein, among two inlet ports on both sides of the diagram, a positive ion source 8 and a negative ion source 9 are provided on the same side so as to introduce the positive ions and negative ions from the same inlet port. In the generally used ion trap, a radio frequency voltage $V_{rf}$ expressed as Equation 1 is applied, for example, to a ring electrode of a three-dimensional ion trap, or to a quadrupole electrode of a linear ion trap.

(Equation 1)

$$V_{rf}=V_O\cdot\cos(2\pi\omega t) \qquad \text{Equation 1}$$

$V_0$ represents the amplitude of a radio frequency voltage, and ω represents the frequency of the radio frequency voltage.

In the present invention, there are proposed two or more power supplies 35 that sinusoidally temporally modulate the radio frequency voltage amplitude of a voltage applied to the electrodes, the two or more power supplies having different phases of a sine wave of the same frequency. The radio frequency voltage amplitude $V_0$ is modulated and applied to the plurality of electrodes 1 each having a circular hole opened therein. Namely, the radio frequency voltage is applied so as to temporally change with a factor of cos Ωt. Moreover, to the adjacent electrodes, with regard to this factor of cos Ωt, the radio frequency voltage is preferably applied so as to have a phase difference of 2π/m (m is an integer). By setting the phase difference to 2π/m, the same voltage can be applied to every certain number of electrodes and therefore the present method can be implemented with fewer power supplies, which is efficient. Reference numeral m denotes the number of electrodes 1 per cycle, and the same voltage is applied to every m electrodes. Namely, in this disclosure, the radio frequency voltage is applied as shown in Equation 2.

(Equation 2)

$$\text{Radio frequency voltage: } V_{mn} = V_0\cdot\cos 2\Pi\left(\Omega t-\frac{n}{m}\right)\cdot\cos(2\Pi\omega t) \qquad \text{Equation 2}$$

$V_0$ represents the amplitude of the radio frequency voltage, Ω represents the frequency of $V_0$, m and n are integers, and t is time. FIGS. 3A to 3D show specific examples. By substituting m=4, n=0, 1, 2, and 3, frequency Ω=1 kHz, and ω=50 kHz into the above Equation 2, electrode applying voltages having four different phases, i.e., $V_{40}$, $V_{41}$, $V_{42}$, and $V_{43}$ as shown in FIGS. 2A and 2B and FIGS. 3A to 3D, are calculated, and $V_{40}$ is applied to an electrode 2, $V_{41}$ to an electrode 3, $V_{42}$ to an electrode 4, and $V_{43}$ to an electrode 5.

(Equation 3)

$$V_{40} = V_0\cos 2\Pi(\Omega t)\cdot\cos 2\Pi(\omega t)\ \ [m=4, n=0]$$

$$V_{41} = V_0\cos 2\Pi\left(\Omega t-\frac{1}{4}\right)\cdot\cos 2\Pi(\omega t)\ \ [m=4, n=1]$$

$$V_{42} = V_0\cos 2\Pi\left(\Omega t-\frac{1}{2}\right)\cdot\cos 2\Pi(\omega t)\ \ [m=4, n=2]$$

$$V_{43} = V_0\cos 2\Pi\left(\Omega t-\frac{3}{4}\right)\cdot\cos 2\Pi(\omega t)\ \ [m=4, n=3]$$

$V_{40}$ is applied to the next electrode 6, $V_{41}$ to an electrode 7, and so on. In this manner, in the case of m=4, a voltage having a different phase by π/2 is repeated, and the same voltage is applied to every four electrodes.

Figure 4A:
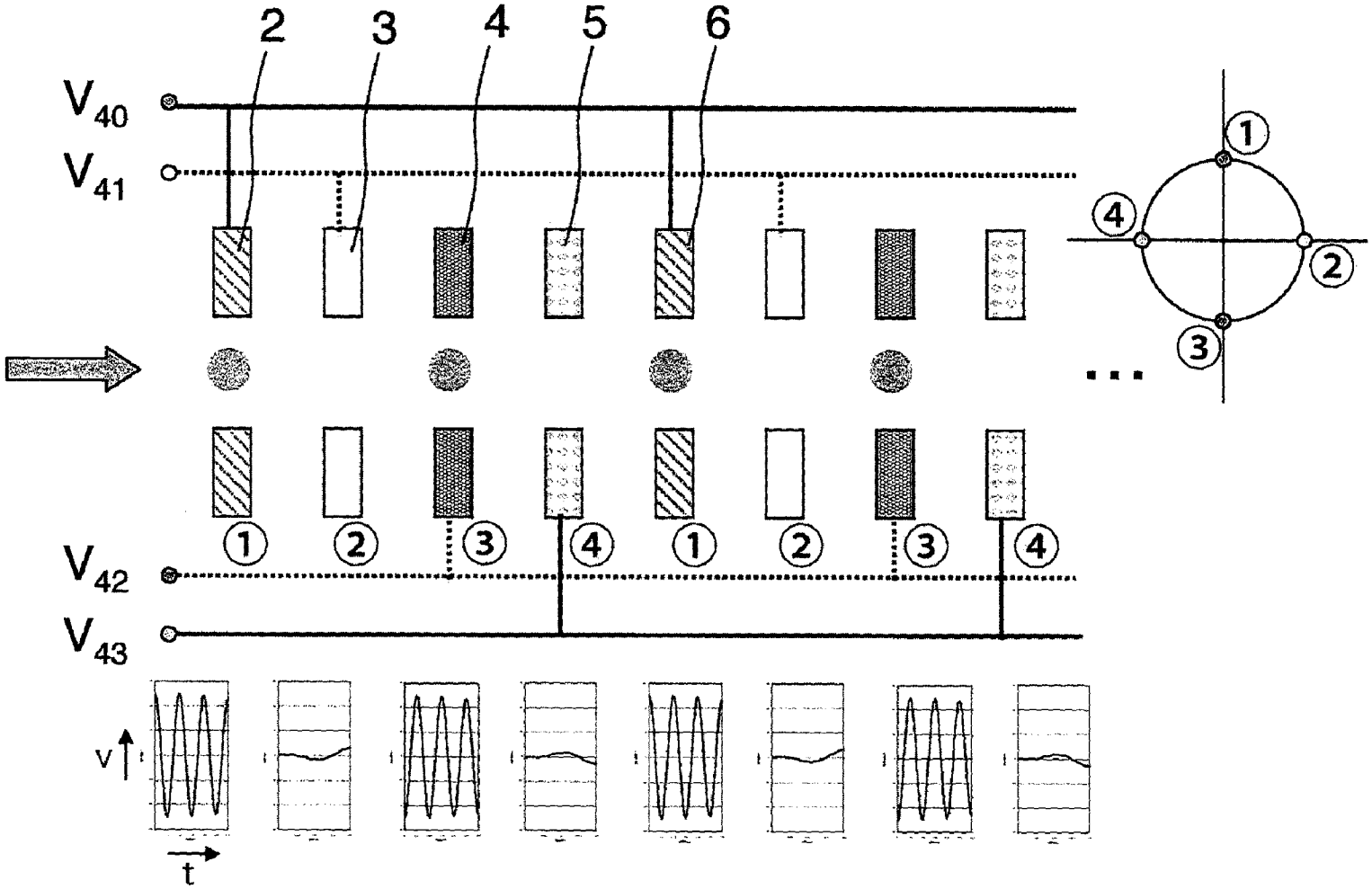
FIG. 4A is a schematic diagram for explaining the movement of positive ions and negative ions in the electron transfer dissociation cell.
Figure 4B:
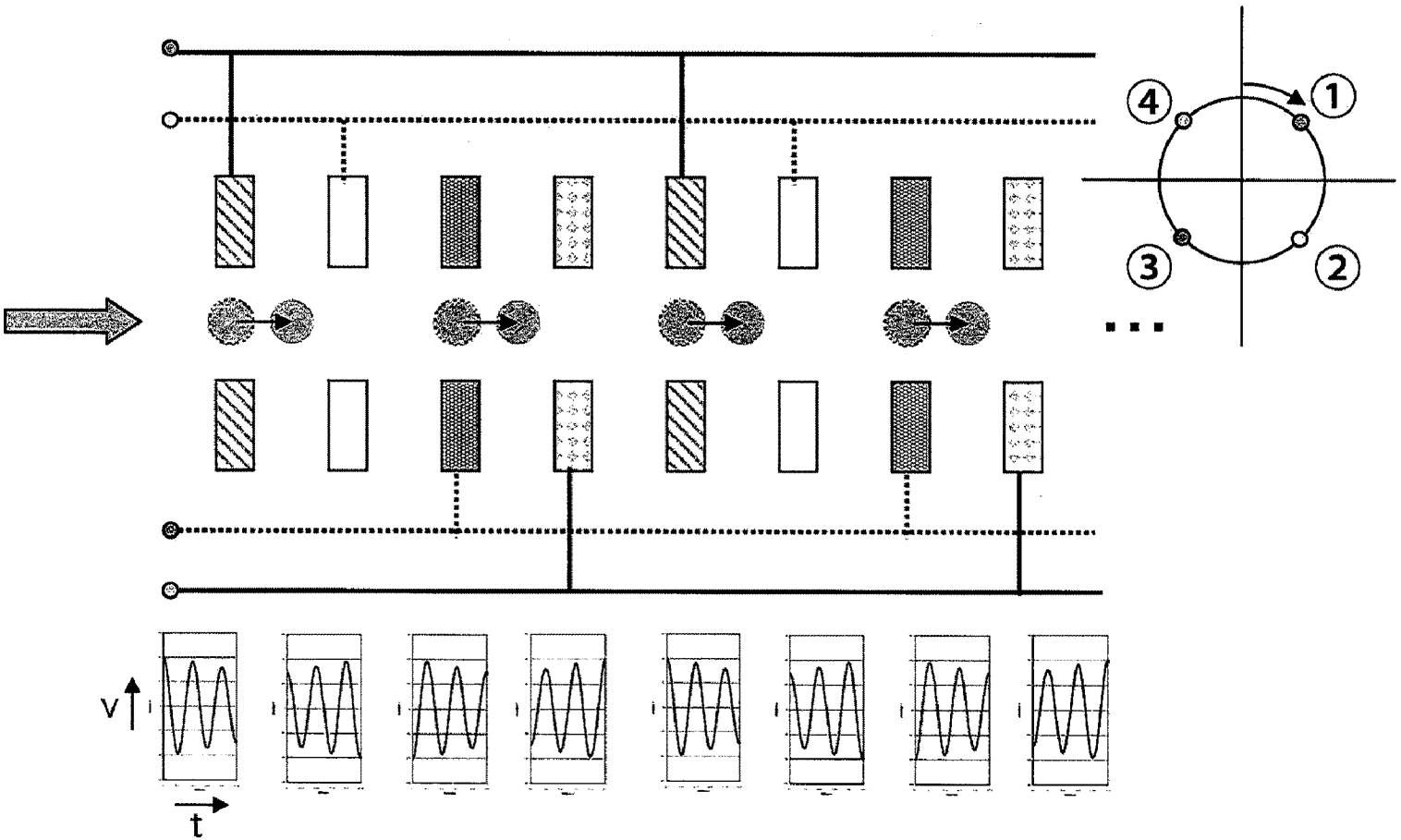
FIG. 4B is a schematic diagram for explaining the movement of positive ions and negative ions in the electron transfer dissociation cell.

FIGS. 4A and 4B are cross sectional views along the central axis of the plurality of electrodes 1 each having a circular hole opened therein of FIG. 1, illustrating specific movements of the ions at the time of m=4. Moreover, numbers [1] to [4] below the electrodes indicate that the same voltage is applied to the electrodes of the same number. Circles on the right sides of FIGS. 4A and 4B indicate the phase of each of the electrodes [1] to [4], where in the case of m=4 the phases are shifted by π/2 as shown in the view. The positive ions and negative ions enter from the left side of the view. Here, both the positive and negative ions can be handled without distinction because the potential formed by the radio frequency is the same.

$$\left(\cos 2\Pi\left(\Omega t - \frac{n}{m}\right) = 1, \quad \cos 2\Pi(\omega t) = 1\right) \qquad \text{(Equation 4)}$$

When a maximum of the radio frequency voltage is applied to the electrode 2 (at the time of t=0 sec of FIG. 5), the radio frequency voltage of the electrode 3 is about 0 V. Moreover, although there is no electrode on the left side, if a ground electrode is placed there, it may be set to 0 V. At this instance, a local ion trap centering around this electrode 2 is created and the both positive ions and negative ions are captured near the electrode 2 at the same time. By the same token, at the time of t=0, the ions are also captured near the electrodes 4 and 6. (Refer to FIG. 4A). As time passes and when the phase of the radio frequency voltage of each electrode of the plurality of electrodes 1 each having a circular hole opened therein leads by π/4 (at the time of t=0.125 msec of FIG. 5), the radio frequency voltage of each electrode varies as shown in FIG. 4B. At this instance, the radio frequency voltages of the electrode 2 and the electrode 3 show the same phase and almost equal voltage while the electrode 4 and the electrode 5 have the opposite phase. Between t=0 to t=0.125 msec, the ions near the electrode 2 are pulled toward the electrode 3 to form a local ion trap centering around the electrode 2 and electrode 3, and at the time of t=0.125 msec the positive ions and negative ions stay near the center of the electrode 2 and the electrode 3. (Refer to FIG. 4B). Similarly, ions captured near the electrode 4 at the time of t=0 will be captured near between the electrode 4 and the electrode 5 in t=0.125 msec.

By applying a voltage as shown in Equation 2, such operation is repeatedly performed and the positive and negative ions are sequentially transferred from the left to the right of the view.

Figure 5:
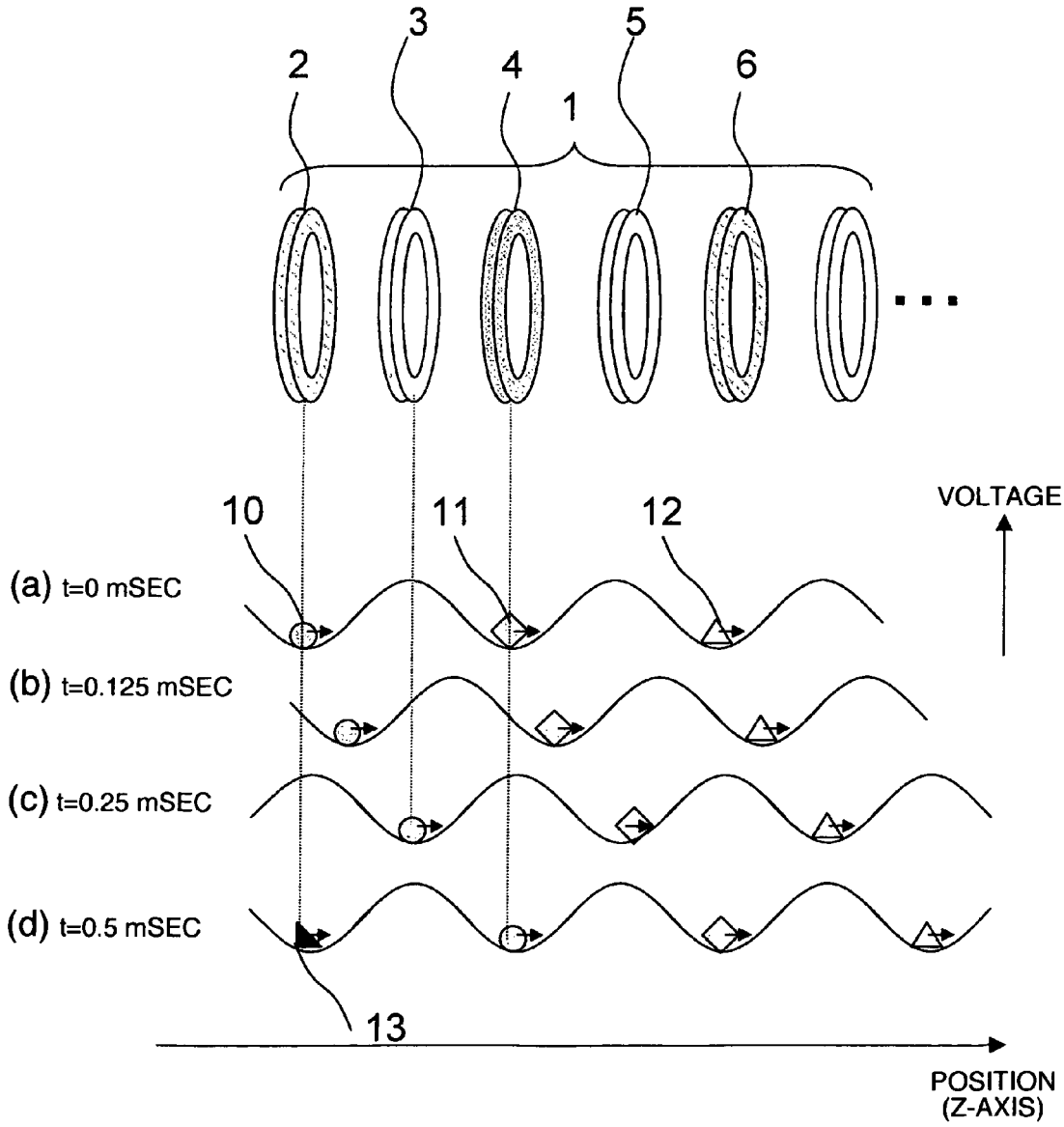
FIG. 5 is a schematic diagram for explaining the movement of ions captured by the electron transfer dissociation cell and pseudopotential.

FIG. 5 shows the potential at each electrode position under the conditions shown in FIGS. 3A to 3D and FIGS. 4A and 4B. In the lower part of the view, the horizontal axis represents the position in the ion traveling direction (Z-axis) corresponding to the electrode diagram in the upper part of the view while the vertical axis represents the potential which the radio frequency wave for the positive and negative ions forms. The ions are captured in the potential valley formed by the radio frequency wave, as shown in the view. As previously described, at the time of t=0 sec (FIG. 5, (*a*)), the potential near the electrodes 2, 4, 6 is low to form a valley, and the positive and negative ions are captured near the electrodes 2, 4, 6. This potential valley moves to the right side of the view with time, and the ions also move along with this move. For example, from t=0 to around t=0.25 msec, the positive and negative ions 10 sequentially move from near the electrode 2 to near the electrode 3 along with the movement of the potential valley. Moreover, in t=0.5 msec, the ions reach near the electrode 4.

This transfer speed of ions, i.e., the transfer speed of the potential valley, is determined by the frequency Ω. Moreover, the transit time of the ions inside the plurality of electrodes is determined by the frequency Ω and the number of electrodes. For example, in the case of m=4, Ω=1 kHz, and 40 electrodes, an ion travels at the speed of 1 msec/four electrodes, and the residence time of an ion inside the plurality of electrodes 1 each having a circular hole opened therein is around 10 msec. Moreover, in this case, as shown in FIG. 5, the ion injection is allowed at every 0.5 msec (2 kHz). Moreover, even with a configuration of m=4, Ω=0.5 kHz, and 20 electrodes, the residence time of ions can be set to around 10 msec. The ion injection in this case is allowed at every 1 msec (1 kHz). In this way, the injection interval of an ion will increase if the number of electrodes is reduced. However, if an ion trap or the like is placed at the preceding stage to accumulate ions, there will be no loss of ions. In the examples of FIGS. 2A and 2B, the radio frequency voltage frequency ω used in the ion trap is set to 50 kHz, however, actually, a radio frequency voltage frequency at around from 100 kHz to several tens of MHz is often used.

Since these operations allow for the transfer of the positive ions and negative ions while these ions remain confined in the same area, the charged particle reaction of the positive ions and negative ions is able to occur during the transfer. Accordingly, the charged particle reaction such as electron transfer dissociation will proceed. In this way, the ions can transit therethrough while securing the reaction time without the ions having different masses being mixed with each other.

Moreover, in the same manner, PTR can be also performed using a negative ion source. Moreover, a particle reaction using FAB can be also achieved by replacing the negative ion source with an FAB ion source. However, if neutral particles are emitted from FAB, the neutral particles need to be directly introduced and collided because an optical system cannot be used.

Embodiment 2

Figure 6:
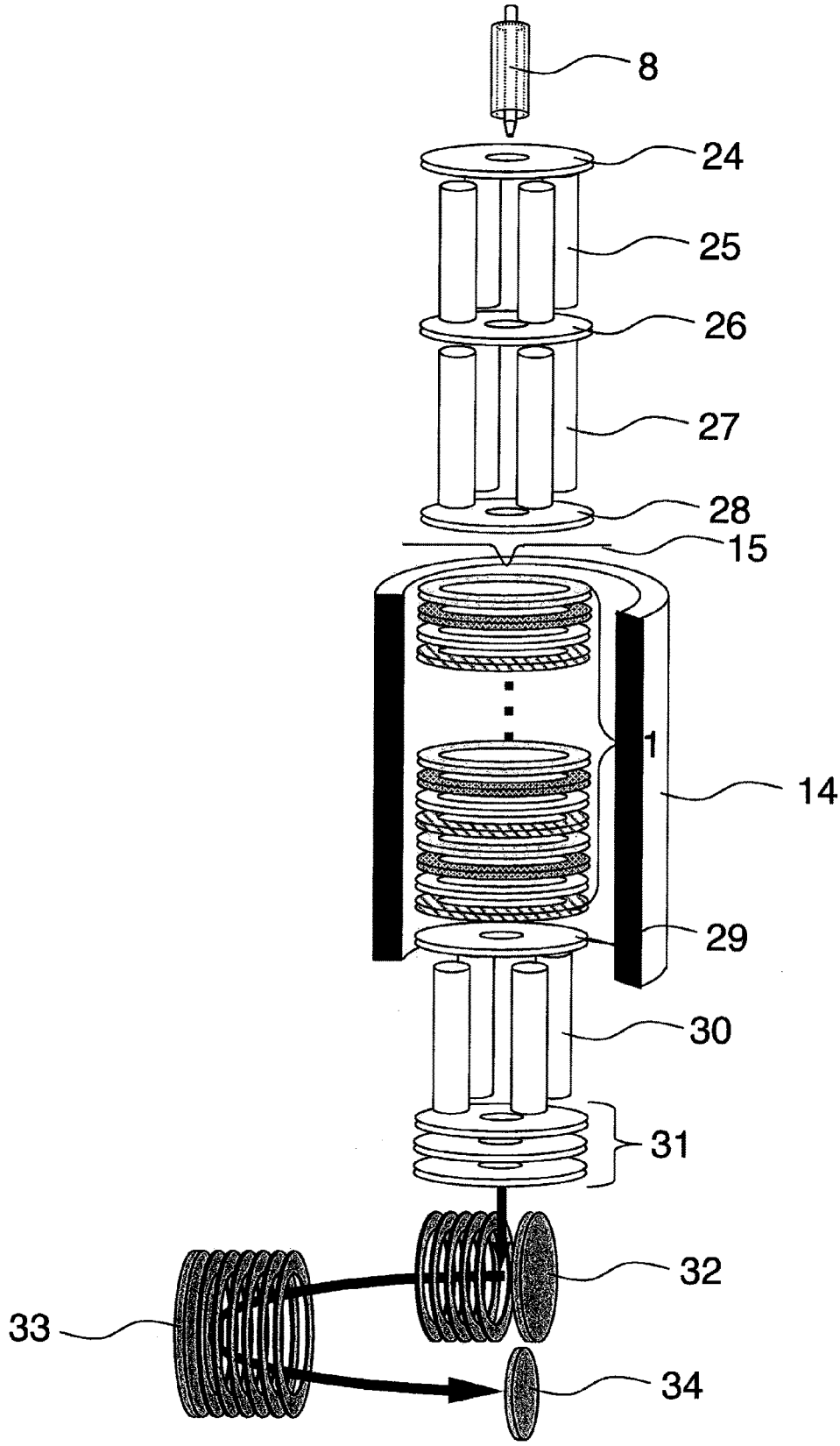
FIG. 6 is a schematic diagram for explaining an embodiment of a mass spectrometer comprising an electron capture dissociation (ECD) cell comprising a plurality of electrodes each having a hole opened therein; a linear ion trap; and a time-of-flight mass spectrometer.

FIG. 6 is a schematic diagram for explaining an embodiment of a mass spectrometer provided with a unit for an Electron Capture Dissociation (ECD) reaction, which is the charged particle reaction between a positive ion and an electron in an ion trap. The overall flow of the analysis is the same as the description of FIG. 1. In the electron capture dissociation reaction cell, electrons are emitted from an electron source 15 to cause an Electron Capture Dissociation (ECD) reaction while positive ions incident upon the plurality of electrodes 1 each having a circular hole opened therein are being captured.

Figure 7:
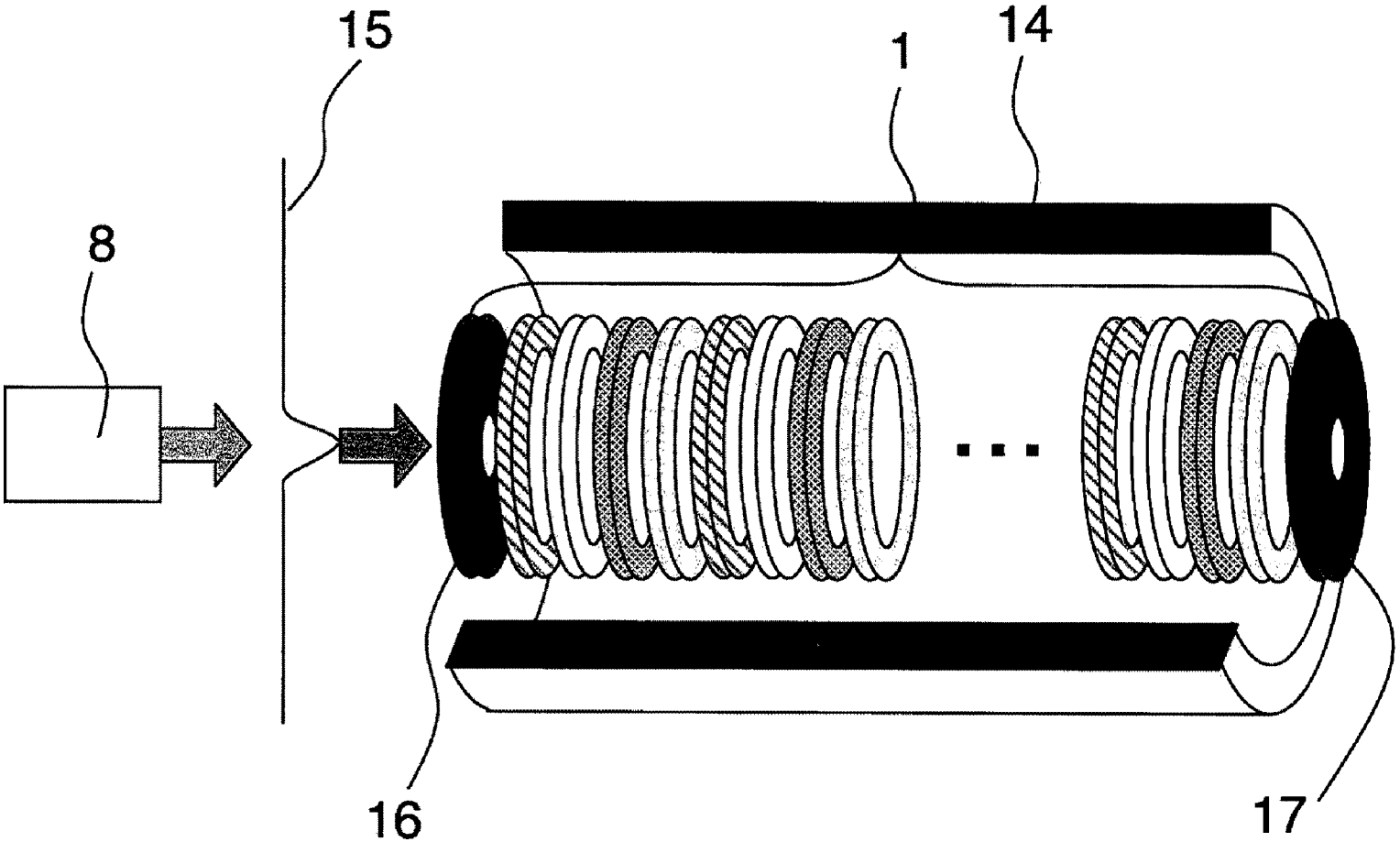
FIG. 7 is a schematic diagram for explaining the embodiment of the electron capture dissociation (ECD) cell comprising a plurality of electrodes each having a hole opened therein.

FIG. 7 illustrates the detail of the electron capture dissociation reaction cell. In the structure comprising the plurality of electrodes 1 each having a circular hole opened therein, a method for applying a radio frequency voltage to the plurality of electrodes 1 each having a circular hole opened therein is the same as the example of FIG. 2A to FIG. 5. The cylindrical magnet 14 is placed, and a magnetic field is applied onto the central axis of an ion trap, so that the electrons may be captured by a magnetic field and the electrons may be introduced efficiently. Moreover, the electron source 15, such as a filament or a dispenser cathode, is placed on the positive ion source 8 side with respect to the plurality of electrodes 1 each having a circular hole opened therein. Moreover, the electron source 15 may be placed on the opposite side of the positive ion source 8 with respect to the plurality of electrodes 1 each having a circular hole opened therein. With regard to the position of the electron source 15, so as to increase the injection efficiency of electrons, the electrons are preferably generated from a portion, which is as close onto the central axis of the plurality of electrodes 1 each having a circular hole opened therein as possible. However, if this significantly decreases the transmissivity of the positive ions, it is necessary to place the electron source 15 a little bit away from the central axis. Electrodes 16, 17 are the wall electrodes. The electrons are extracted or shut off from the electron source 15 by applying a DC voltage to the electrode 16 and thereby the amount of electrons to be introduced can be controlled. Moreover, the electrode 17 can be used as the capture electrode of electrons and can shut off electrons coming out of the charged particle reaction device of the view.

With this configuration, as shown in Equation 2 and FIGS. 1 to 4B, ions are transferred using a radio frequency voltage. Electrons are emitted during the reaction. In the electron capture dissociation, an electron needs to be controlled within the values from around 1 electron volt (eV) to several electron volts. The energy of an electron varies in response to the potential which the radio frequency voltage forms. However, since the object is to allow an electron to collide with an ion that is present at the bottom of the potential, the potential of the plurality of electrodes 1 each having a circular hole opened therein may be adjusted so that the energy of the electron can be controlled to a target value at the bottom of the potential. The above description has been made with regard to the embodiments, but the present invention is not limited thereto, and it is apparent to those skilled in the art that various kinds of changes and modifications can be made within the scope of the spirit of the present invention and the scope of the attached claims.

INDUSTRIAL APPLICABILITY

The present invention can be applied to a method and device for the sequence structure analysis of biopolymers using a mass analysis method.

The invention claimed is:

1. An ion guide device, comprising:

a plurality of electrodes each having a circular hole opened therein, the plurality of electrodes being serially arranged in an axial direction; and two or more power supplies that periodically change an amplitude of a radio frequency (RF) voltage applied to the electrodes, wherein phases of the periodically changed RF voltages differ from each other, wherein by applying the RF voltages with the periodically changing amplitudes to the electrodes, an ion is captured and transferred in the axial direction by an RF electric field formed on a central axis of the plurality of electrodes.

2. The ion guide device according to claim 1, wherein the phases of the periodically changed RF voltages differs by $2\pi/m$ (m is an integer no less than 2) at every adjacent electrodes of the serially-arranged plurality of electrodes.

3. The ion guide device according to claim 1, wherein a particle reaction is caused by providing a particle source that generates a medium particle capable of changing an electric charge of a sample ion.

4. The ion guide device according to claim 1, wherein electron transfer dissociation is caused by providing a negative ion source.

5. The ion guide device according to claim 1, wherein electron capture dissociation is caused by providing an electron source.

6. The ion guide according to claim 1, wherein the ion is captured and transferred in the axial direction without requiring application of a DC voltage.

7. An ion reactor, comprising:

a plurality of electrodes each having a circular hole opened therein, the plurality of electrodes being serially arranged in an axial direction;

two or more power supplies that periodically change an amplitude of a radio frequency (RF) voltage applied to the electrodes by amplitude modulation, wherein phases of the periodically changed RF voltages differ from each other;

a positive ion source and a negative ion source; and a system for introducing the two ion sources, wherein wherein by applying the RF voltages with the periodically changing amplitudes to the electrodes, electron transfer dissociation is caused while capturing and transferring an ion in the axial direction by an RF electric field formed on a central axis of the plurality of electrodes.

8. The ion reactor according to claim 7, wherein the phases of the periodically changed RF voltages differs by $2\pi/m$ (m is an integer no less than 2) at every adjacent electrodes of the serially-arranged plurality of electrodes.

9. The ion reactor according to claim 7, wherein the ion is captured and transferred in the axial direction without requiring application of a DC voltage.

10. An ion reactor, comprising:

a plurality of electrodes each having a circular hole opened therein, the plurality of electrodes being serially arranged in an axial direction;

two or more power supplies that periodically change an amplitude of a radio frequency (RF) voltage applied to the electrodes by amplitude modulation, wherein phases of the periodically changed radio frequency (RF) voltages differ from each other;

a magnetic field generator that generates a magnetic field in a direction including a central axis of the plurality of electrodes; and an electron source that introduces an electron in a central axis direction of the plurality of electrodes, wherein by applying the RF voltages with the periodically changing amplitudes to the electrodes, electron capture dissociation is caused while capturing and transferring an ion in the axial direction by an RF electric field formed on the central axis of the plurality of electrodes.

11. The ion reactor according to claim 10, wherein the phases of the periodically changing RF voltages differ by $2\pi/m$ (m is an integer no less than 2) at every adjacent electrodes of the serially-arranged plurality of electrodes.

12. The ion reactor according to claim 10, wherein the ion is captured and transferred in the axial direction without requiring application of a DC voltage.

13. A mass spectrometer, comprising:

an ion source;

an ion trap that traps an ion ionized by the ion source;

a plurality of electrodes each having a circular hole opened therein, the plurality of electrodes being serially arranged in an axial direction, the circular hole being for introducing an ion ejected from the ion trap;

two or more power supplies that periodically change an amplitude of a radio frequency (RF) voltage applied to the electrodes by amplitude modulation, wherein phases of the periodically changed RF voltages differ from each other; and a detection part that detects the ion ejected from the electrodes, wherein with the use of the voltages applied by the power supplies, the RF voltages with periodically changing amplitudes are applied to the electrodes and an ion is captured and transferred by an RF electric field formed on a central axis of the plurality of electrodes.

14. The mass spectrometer according to claim 13, wherein the phases of the periodically changed RF voltages differ by $2\pi/m$ (m is an integer no less than 2) at every adjacent electrodes of the serially-arranged plurality of electrodes.

15. The mass spectrometer according to claim 13, wherein a negative ion source is provided between the ion trap and the electrodes.

16. The mass spectrometer according to claim 13, further comprising: a magnetic field generator that generates a magnetic field in a direction including a central axis of the electrodes; and an electron source that introduces an electron in a direction of the central axis of the electrodes.

17. The ion guide according to claim 13, wherein the ion is captured and transferred in the axial direction without requiring application of a DC voltage.

* * * * *